US005694724A

United States Patent [19]

Santiago

[11] Patent Number: 5,694,724

[45] Date of Patent: Dec. 9, 1997

[54] VENT PIPE COVER

[76] Inventor: Jacinto Santiago, 11581 NW 23rd St., Plantation, Fla. 33323

[21] Appl. No.: 602,615

[22] Filed: Feb. 16, 1996

[51] Int. Cl.[6] ..... E04D 13/08

[52] U.S. Cl. ..... 52/219; 285/44; 52/97; 52/199

[58] Field of Search ..... 52/58, 62, 97, 52/105, 199, 219, 244; 285/42, 43, 44; 138/96 R, 109, 110

[56] References Cited

U.S. PATENT DOCUMENTS 506,930 10/1893 Nies et al. .
1,923,220 8/1933 Lightbown .
3,436,880 4/1969 Kifer .
3,797,181 3/1974 Nievelt .
4,442,643 4/1984 Stadheim ..... 285/44 X
5,245,804 9/1993 Schiedegger et al. ..... 52/199

*Primary Examiner*—Carl D. Friedman
*Assistant Examiner*—Yvonne Horton-Richardson
*Attorney, Agent, or Firm*—Malin, Haley, DiMaggio & Crosby, PA

[57] ABSTRACT

A plumbing stack vent cover or guard is disclosed which is used for flashing. The cover includes a body member and a base member which are preferably constructed integral. The cover is preferably constructed from a non-metallic material and is also preferably pre-molded in its final form prior to installation. The cover can be installed over an existing plumbing stack vent or installed on a point on the roof where a plumbing stack vent will be installed.

20 Claims, 5 Drawing Sheets

VENT PIPE COVER

BACKGROUND OF THE INVENTION

1. Field of the Invention

The present invention relates generally to the roofing industry, and particularly to a flashing system for plumbing stack vents that protrude from the roofs of buildings and dwellings.

2. Description of the Prior Art

A plumbing stack vent protrudes through a roof to convey and disperse sewer gases. A hole is cut in the roof at the intersection of the roof and the pipe. This hole around a stack vent can cause a roof to leak. Covers for vent pipe protruding out of the roofs of buildings and dwellings are known. Typically, the covers are constructed from lead and require the installer to manually fold the cover over and shape the cover to the vent pipe. A fastening plate is associated with the cover and is commonly screwed into the roof. Several problems exist with such covers, including, but not limited to: (1) the relatively large amount of time required to install the cover, approximately fifteen (15) minutes (which is substantial in light of all other matters which require time when constructing a house or installing a new roof); (2) the use of lead eventually stains the roof; and (3) heat can eventually cause the lead cover to rip, thus, creating a potentially dangerous sharp object.

Examples of previous vent pipe covers ("pipe covers") include U.S. Pat. No. 506,930 issued to Nies et al for an External Joint Escape Pipes; U.S. Pat. No. 1,923,220 issued to Lightbrown for a Vent Pipe Joint Guard; U.S. Pat. No. 3,436,880 issued to Kifer for a Counter Flashing; and U.S. Pat. No. 3,797,181 to Nievelt for a Roof Vent Pipe Shield.

The Lightbrown, Kifer and Nievelt references disclose pipe covers with separate base plates. These type of structures (multiple pieces) suffer several inadequacies including, but not limited to, the potential for leaks into the attic area of the dwelling or building and compromised structural integrity of the pipe cover.

The Kifer reference discloses a pipe cover with a resilient gripping means (a bulge) of unibody construction, with a flange for connecting to a roof. As the roof pipe is typically installed after the roof membrane is in place, an installer has to return to the construction site to install the Kifer pipe cover.

The Lightbrown reference discloses a two piece construction of a pipe cover. A flange plate and a vertical tubular portion are provided. Both pieces are made of a metallic material. The tubular sleeve is made to fit snuggle around the roof pipe and it is slid over the roof pipe and hammered into place. This installation creates a pressure fit of the sleeve on the roof pipe. The roof pipe must be in place to install the pipe cover. This installation process requires two steps. First the plate must be installed and then the sleeve, thus, requiring a relatively large amount of installation time. Furthermore, the metallic material of the sleeve must be flexible enough to form a pressure fit with the roof pipe. A sleeve made of a metallic material this flexible could be easily damaged during installation by piercing or tearing. This is especially true given the fact that the sleeve must be forced into place by wedging or hammering. Furthermore, being made of a metallic material greatly increases the chances that the associated roof area will eventually be stained.

The Nies et al reference discloses a unibody pipe cover construction that is both a sleeve extending up the pipe and a base lying on the roof of the structure. However, the sleeve terminates before the top of the pipe and a collar is fitted between the sleeve and the pipe. Furthermore, the roof pipe must be present for the installation to be completed. Additionally, the invention is made of cast lead and in order to complete the installation of the pipe cover it is necessary to pour molten lead into the space existing between the sleeve and the pipe. Thus, the above-described limitations are also present in the Nies pipe cover.

The Nievelt reference discloses a roof pipe cover that is not attached to a flange base and therefore, suffers all of the limitations of a multi-piece construction discussed above. Also, the Nievelt pipe cover can only be installed with the roof pipe in place.

Thus, there exist a need for a unibody pipe cover, which is preshaped prior to installation, and is constructed from a non-metallic material. The pipe cover should also be molded at various angels to accommodate the installation site's roof pitch. Furthermore, there also exist a need for a pipe cover which can be installed without the roof pipe being in place. It is therefore, to the effective resolution of the aforementioned problems and shortcomings that the present invention is directed.

SUMMARY OF THE INVENTION

It is the object of this invention to provide a flashing system or pipe cover (these terms will be used interchangeably throughout), that overcomes the limitations and faults of current plumbing stack vent covers and flashing.

Another primary object of the invention is to allow a roofing contractor to complete all roofing obligations without returning to the job site. Currently this cannot be achieved because the plumbing stack vent is typically installed after the roofing system. The installer must then return to the job site to finish flashing the plumbing stack vent. However, with the present invention the flashing system can be installed at a predetermined location on the roof and the plumbing stack vent could be plumbed up or fitted into it.

It is still another object of this invention to provide a cost effective means of flashing a plumbing stack vent. The ease in installation will save time. The method of installation will save on material since installer error is minimized with the present invention. The entire system can be a single molded non-metallic piece that is cost effective to produce. The non-metallic material does not discolor, thus, eliminating the need for painting. Finally, the non-metallic material will not stain the roofing membrane, a common problem of current flashing devices.

It is yet another object of the present invention to provide a vent pipe cover which is substantially maintenance free and last longer as compared to vent pipe covers currently in use.

The present invention pipe cover is made from a suitable nonmetal material, such as, but limited to, polyvinyl chloride (PVC). The pipe cover is molded or casted so that it starts at a base beneath the outer roofing surface, becoming a contiguous article that wraps around the exterior of the plumbing pipe above the roof surface and finally terminates down within the interior of the plumbing pipe. There are no other pieces or materials needed to complete or form the seal. As the present invention pipe cover is of a continuous and all encompassing one piece construction, there are no possible breaches between surfaces. Furthermore, the present invention is basically maintenance free and will last longer as compared to vent pipe covers currently in use.

In accordance with these and other objects which will become apparent hereinafter, the instant invention will now be described with particular reference to the accompanying drawings.

BRIEF DESCRIPTION OF TEE DRAWINGS

The invention may be better understood by reference to the drawings in which:

FIG. 1 illustrates a cross section of the plumbing stack vent cover in place on a cross sectioned roof with a full view stack vent protruding threw the roof;

FIGS. 2 and 2*a* illustrates a cross section of the plumbing stack cover at the range of engagement of the plumbing stack vent;

FIG. 3 illustrates a top view of the plumbing stack vent cover;

FIG. 3*a* illustrates a cross sectional top view of the plumbing stack vent cover and plumbing stack vent;

FIG. 4*a* illustrates the plumbing vent cover of the present invention installed over a plumbing vent;

FIG. 4*b* illustrates the plumbing vent cover just prior to installation;

FIG. 4*c* illustrates a front view of the plumbing vent cover; and

FIG. 4*d* illustrates the roof surface just prior to installation of the plumbing vent cover.

DESCRIPTION OF THE PREFERRED EMBODIMENTS

Figure 1:
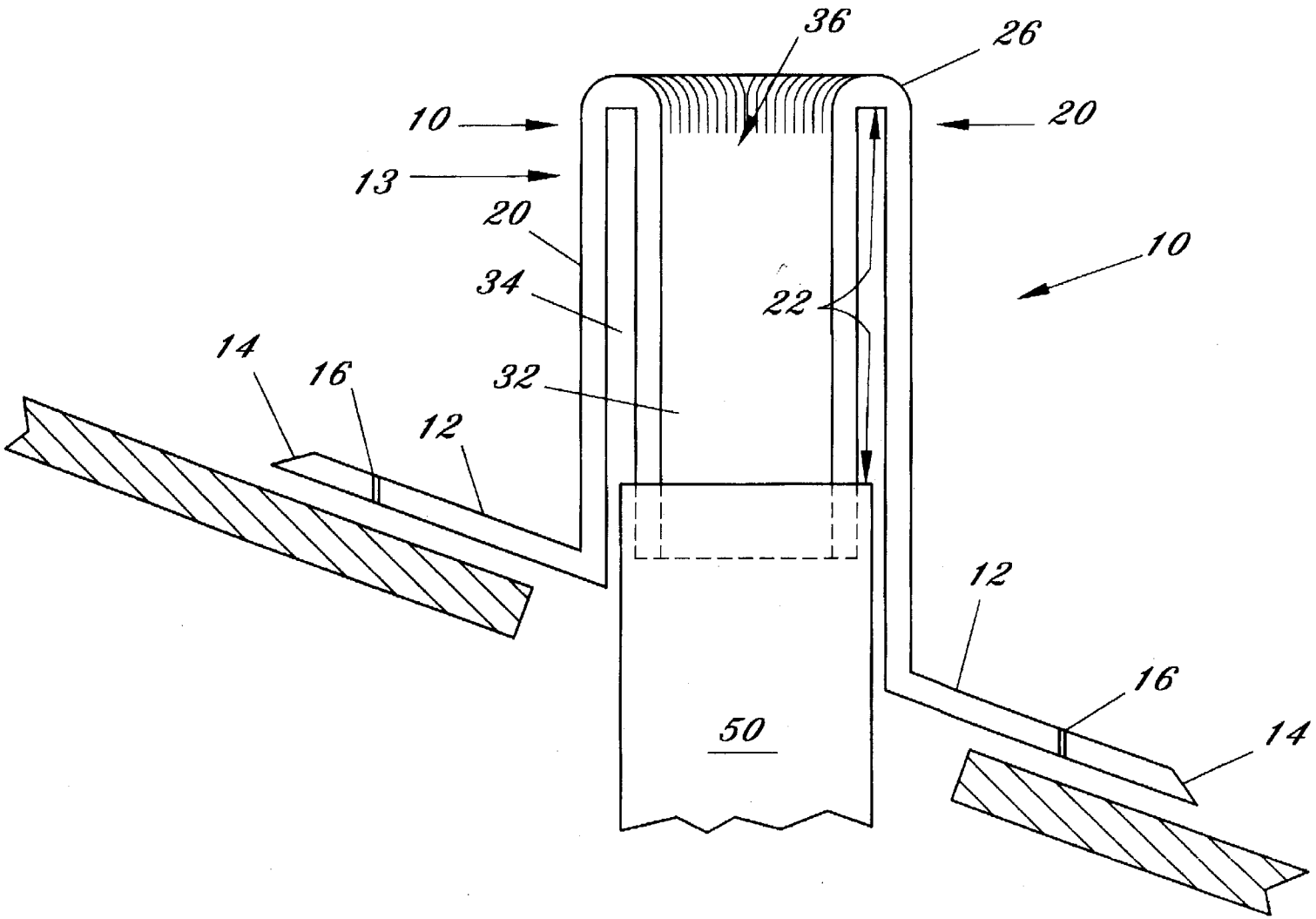
Figure 2A:
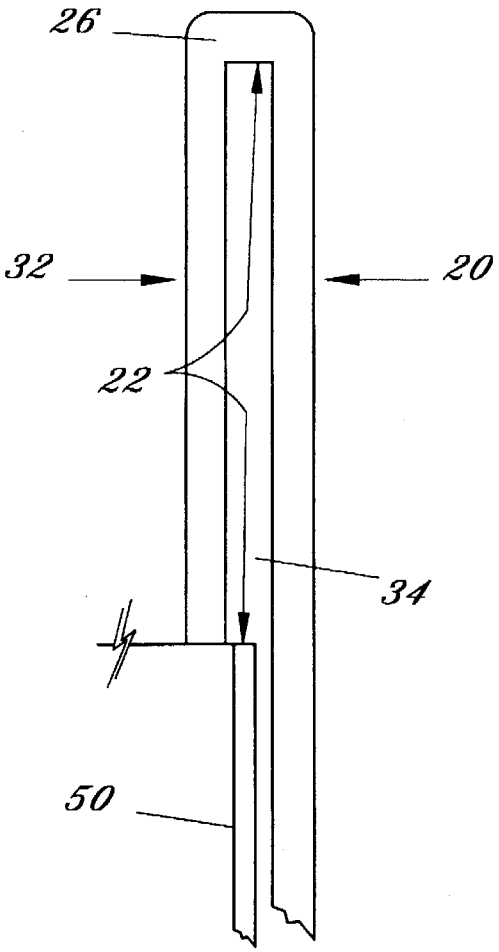
Figure 2:
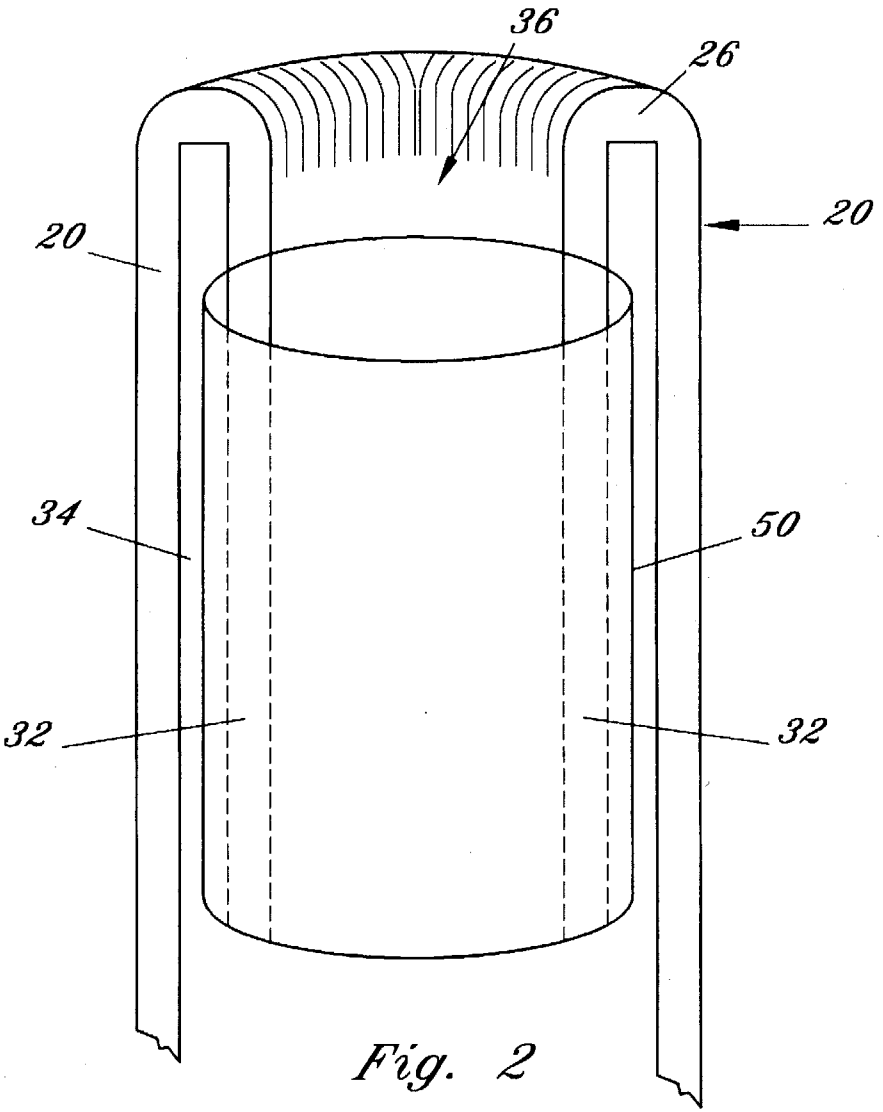

As seen in FIGS. 1, 2 and 2*a* the pipe cover 10 of the present invention is illustrated and generally comprises a single piece of molded non-metallic material. Pipe cover 10 generally consist of a base plate 12 and a body member 13. In the preferred embodiment, the cover is constructed from polyvinyl chloride PVC. However, other materials, which will not stain the associated roof, are considered within the scope of the invention such as fiberglass, corning ware, etc. Furthermore, stainless steel could also be used, but is not preferred do to cost considerations.

Pipe cover 10 includes a base plate 12 which can lay flush on a roof substrate, such as plywood. Base plate 12 can be a tapered at its outer end 14 around the perimeter and also includes mounting holes 16. Body member 13 extends upward from base plate 12 and includes an exterior section 20, intermediate section 26 and an interior section 32. Sections 20, 26 and 32 are, preferably, constructed integral to define a single body member 13, however, such is not limiting.

Exterior section 20 extends a certain distance, illustrated as reference numeral 22 above the upper most point of plumbing stack vent or pipe 50. The top of exterior section 20 is associated with the first end of intermediate section 26 which is disposed at the top end of body member 13. The second end of intermediate section is associated with a first end of interior section 26. Interior section 32 extends downward from intermediate section 26 to a point lower than the upper most edge of stack vent 50 to allow a portion of intermediate section 26 to be disposed within pipe 50. Thus, exterior section 20, intermediate section 26 and interior section 32 define a cylindrical cavity or channel 34, and a portion of the wall of stack vent 50 fits into cylindrical cavity 34.

Interior section 32 defines a hole 36 which is open to the weather. When moisture enters hole 36 it is directed harmlessly into stack vent 50. Moisture falling around the stack vent or traveling down the roof toward the stack vent will go around it, since there is continuity between base plate 12 and exterior section 20. Thus, the possibility of moisture traveling between base plate 12 and exterior section 20 is eliminated.

As best seen in FIGS. 2 and 2*a* intermediate section 26 is preferably provided with an area of increased thickness as a precautionary measure to provide reinforcement in the unlikely event that damage would occur from an external force or an internal force cause by an inadequate distance 22. Thus, the extra thickness can be provided in the remote event the upper most surface of stack vent 50 presses against stack vent cover 10 at intermediate section 26.

Figure 3:
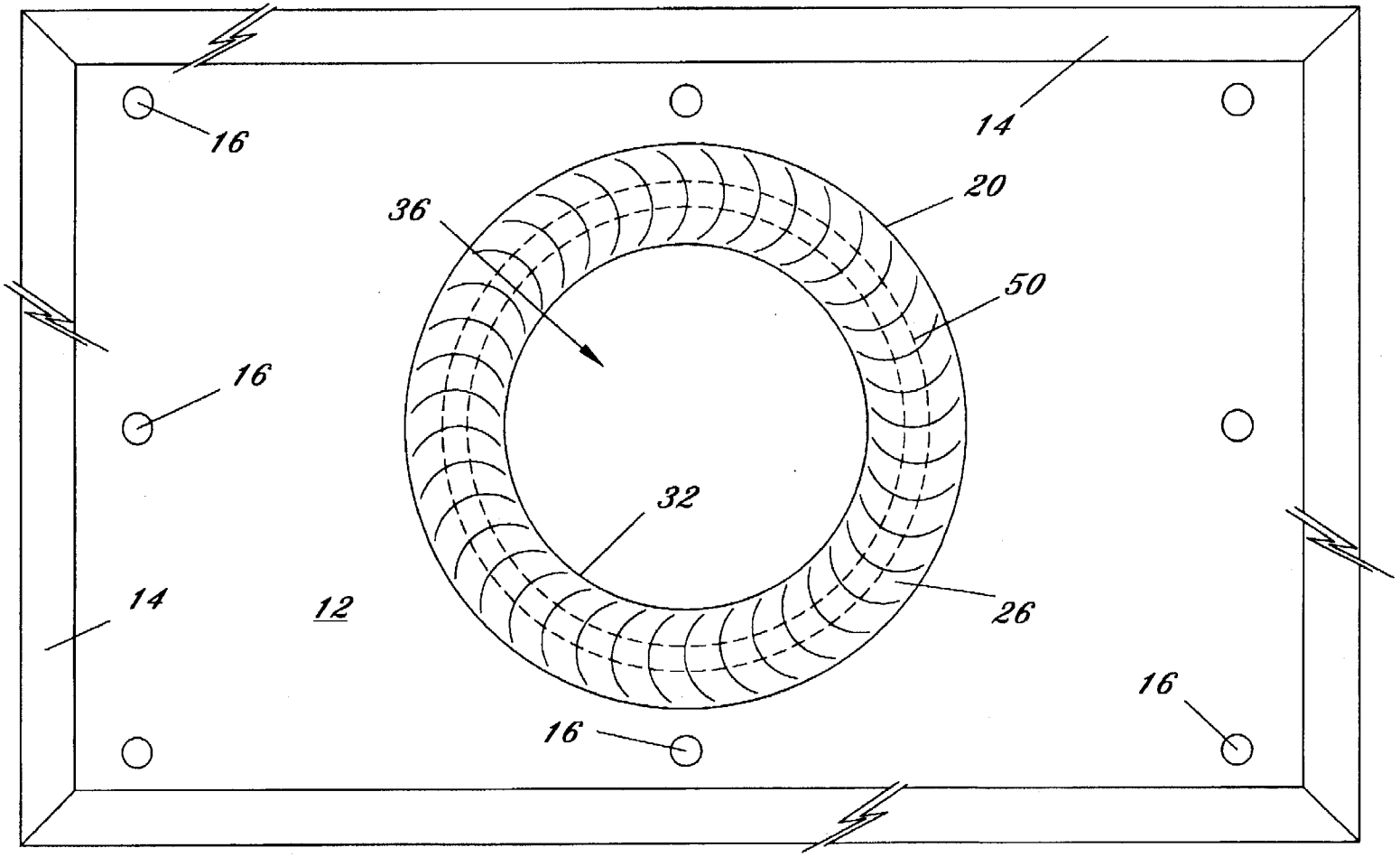
Figure 3A:
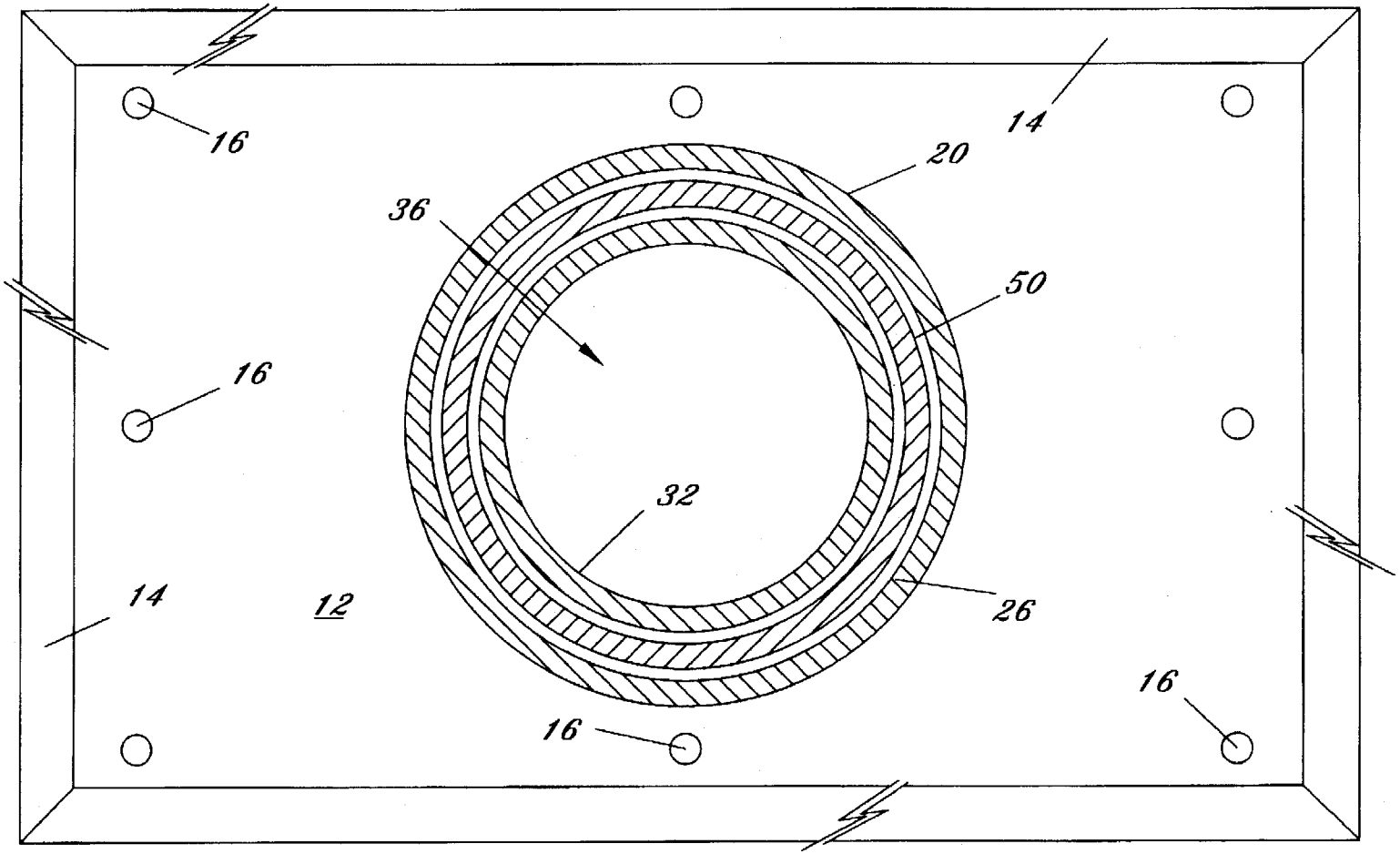

FIGS. 3 and 3*a* illustrate a top view of stack vent cover 10. As shown in FIGS. 3 and 3*a* a plurality of installation mounting apertures 16 are provided. Preferably, eight apertures 16 are provided equally spaced around base plate 12, proximal to tapered end 14. Though eight apertures are preferred, such number is not limiting, and any amount of apertures 16 can be provided, which will maintain cover 10 in place, in conjunction with mounting screws, nails, etc. Though not preferred, mounting holes 16 can be eliminated and base plate can be attached by other conventional attachment means, such as extra-strength adhesives or tapes.

Also seen in FIGS. 3 and 3*a* is the fact that exterior section 20 and interior section 32 are preferably cylindrical shape to correspond to the cylindrical shape of pipe 50. Thus, if pipe 50 is of another shape, exterior sections 20 and 32 should be shaped accordingly, if necessary, to accomplish the goals of the present invention. Furthermore, body member 13 is preferably substantially centered with respect to base plate 12.

Figures 4A, 4B, 4C, 4D:
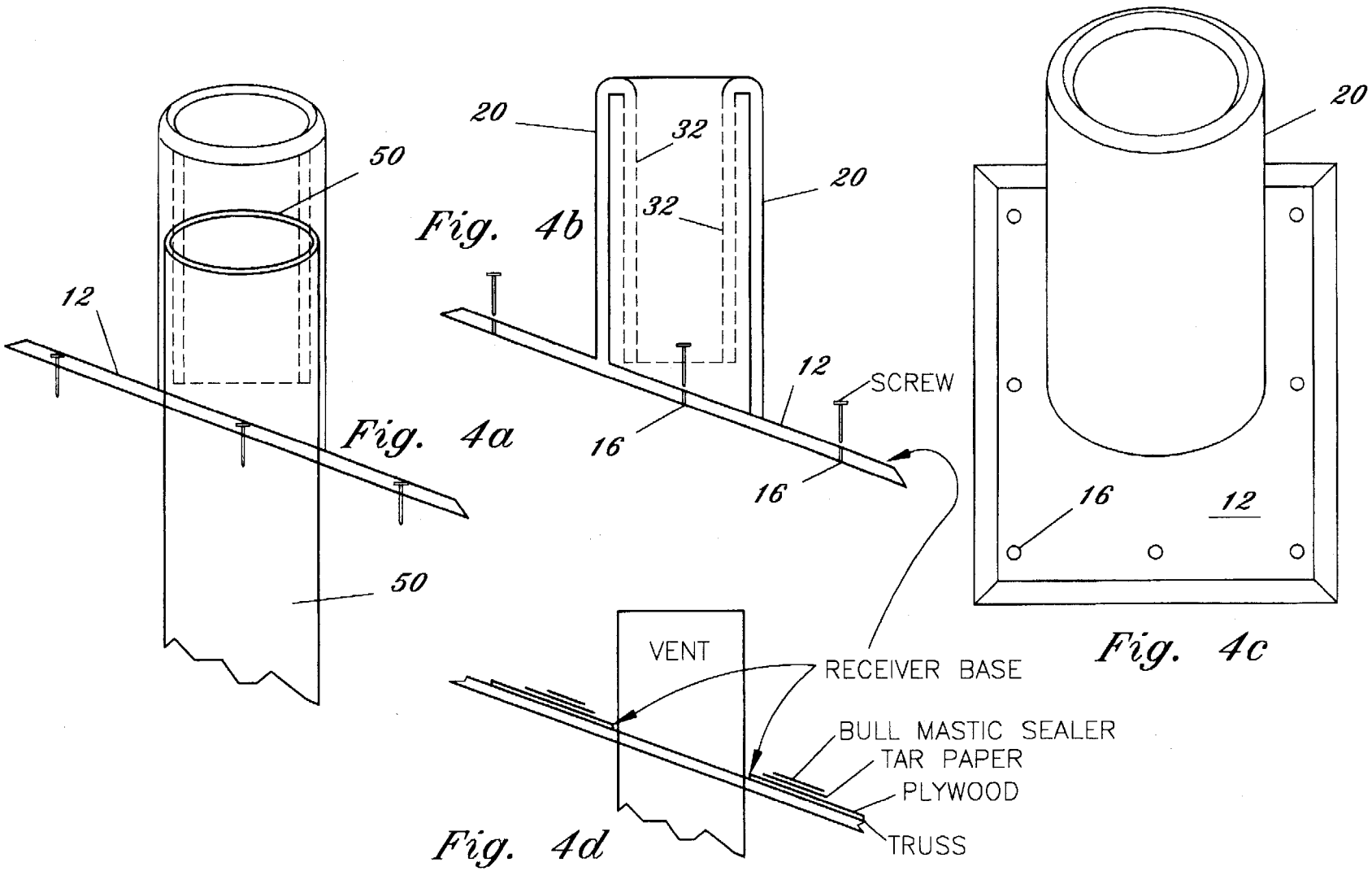

FIGS. 4*a*, 4*b*, 4*c*, and 4*d* best show the installation of stack vent cover 10. FIG. 4*a* shows stack vent cover 10 installed on a pitched roof surface. FIG. 4*b* shows stack vent cover 10 just prior to installation on a pitched roof surface. FIG. 4*c* is an isometric view of a stack vent cover 10 showing cylindrical exterior surface 20 having an outer diameter of 4½ inches. In the preferred PVC embodiment, cover 10 weighs a little more than three pounds, though such should not be considered limiting in any way. FIG. 4*d* shows the roof surface just prior to installation and includes typical application of a sealer in the corresponding base plate 12 area on tar paper that is over a plywood roof decking. The plywood roof decking is typically nailed to roof trusses.

Typical uses in the field include installation before and after stack vent installation, as pipe cover 10, including body member 13 is premolded and in its final shape prior to installation. When stack vent cover 10 is installed before stack vent 50, the proper location on the roof must be determined from architecture plans. Once located a hole is place in the roof to suit protrusion of the stack vent. The roofing contractor can then begin roofing by typically laying down tar paper over a preinstalled plywood deck. When the tar paper is placed over the stack vent hole it is cut in a similar corresponding manner to allow the hole to remain. Cover 10 is axially aligned to the stack vent hole so that hole 36 is axially aligned with the stack vent hole. Just prior to installation of stack vent cover 10 a sealer is place either on the tar paper or the bottom surface of base plate 12. Cover 10 is then placed on the tar paper, with the sealer in between and screwed into place, by screwing in mounting screws, each associated with one of mounting holes 16. Later the plumber can bring stack pipe 50 up into cylindrical cavity 34 defined by exterior section 20, intermediate section 26 and interior section 32. A portion of the wall of stack vent 50 fits into cylindrical cavity 34.

When stack vent 50 is already in place the location of stack vent cover 10 does not need to be determined. However, the installation is the same, excepted that stack vent cover 10 must be place over stack vent 50.

Once stack vent cover 10 is in place roofing membrane is applied to the roof with standard procedures. However, if the roof membrane is installed over an existing stack vent an area should be prepared so that the stack vent cover can be installed to a substrate such as tar paper and the roofing membrane relayed around the stack vent cover.

Thus, the installation of stack vent cover 10 can be completed in the mist of roofing regardless of the presence of the stack vent and the installer does not have to return to the job site. Furthermore, there is no joining of two flashing surfaces which eliminates concerns about shrinkage, peeling, and freezing/thawing temperatures degrading the joining of two flashing surfaces.

The unibody construction is superior to past multiple piece embodiments because there are no joined surfaces of separate parts. Each time a two surfaces are joined in a roofing application there develops the possibility of joint failure. In the event of joint failure there develops a passage in the joint from way which a leak may develop. Although it is true that, for example, two surfaces joined by a weatherproof caulking substance maybe leak proof at installation, the passage of time will deteriorate the joining and cause leaks. Furthermore, if the installation that causes the two surfaces to be joined (i.e., the caulking process) is not done properly, the joining of the two surfaces may leak from the moment of such improper installation. The present invention unibody construction for pipe cover 10 eliminates deterioration of any joining method and eliminates any human error in any joining method process.

Moreover, with any multiple piece construction of a pipe cover there is inevitable an assembly process. This process is performed at installation, on the roof top of a building. Whatever joining method is used, it involves time and material. If the roof top is considerably pitched or steep it may increase the installation time. If installation is performed improperly it will have to be started again. This wastes time and usually considerable material. However, the present invention pipe cover 10 is simply slid over pipe 50 and nailed or screwed in place without extra time or material being consumed.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A plumbing vent pipe cover for flashing a plumbing stack vent that protrudes from a roof of a building or dwelling, said cover comprising;

a base member having a bottom surface and a top surface, said base member constructed from a non-metallic material, said base member adapted to be attached and sealed to the roof to prevent moisture leakage and drainage on and around the vent pipe;

a body member constructed from a non-metallic material, said body member including an exterior section, intermediate section and an interior section, said exterior section, intermediate section and interior section defining a channel therebetween, said body member constructed integral with said base member;

wherein when said cover is installed said interior section terminates at a point lower than where an upper most point of an installed plumbing stack vent is located to allow a portion of the interior section to be disposed within an installed plumbing stack vent.

2. The plumbing vent pipe cover of claim 1 wherein the cover is pre-molded in its final form prior to installation of said cover.

3. The plumbing vent pipe cover of claim 1 wherein said body member and said base member are constructed from poly vinyl chloride.

4. The plumbing vent pipe cover of claim 1 wherein said base member having a plurality of holes sized to accept mounting hardware.

5. The plumbing vent pipe cover of claim 4 wherein said base member having eight holes equally spaced from the center of the base plate.

6. The plumbing vent pipe cover of claim 1 wherein the base has a tapered perimeter.

7. The plumbing vent pipe cover of claim 1 wherein said exterior section is greater in length than a portion of the plumbing stack vent which protrudes out of the roof.

8. The plumbing vent pipe cover of claim 1 wherein the stack vent having an outer diameter and said exterior section having an inner diameter larger than the outer diameter of the stack vent.

9. The plumbing vent pipe cover of claim 1 wherein the stack vent having an inner diameter and said interior section having an outer diameter smaller than the inner diameter of the stack vent.

10. The plumbing vent pipe cover of claim 1 wherein said exterior section and said interior section are substantially cylindrical in shape.

11. A plumbing vent pipe cover for flashing a plumbing stack vent that protrudes from a roof of a building or dwelling, the stack vent having an outer diameter and an inner diameter and being substantially cylindrical in shape, said cover comprising;

a base member having a bottom surface and a top surface, said base member constructed from a non-metallic material, said base member adapted to be attached and sealed to the roof to prevent moisture leakage and drainage on and around the vent pipe;

a substantially cylindrically shaped body member constructed from a non-metallic material, said body member including an exterior section, intermediate section and an interior section, said exterior section, intermediate section and interior section defining a channel therebetween, said exterior section having an inner diameter larger than the outer diameter of the stack vent, said interior section having an outer diameter smaller than the inner diameter of the stack vent, said body member constructed integral with said base member;

wherein when said cover is installed a portion of said interior section is disposed within said stack vent and said interior section terminates at a point lower than an upper most point of the plumbing stack vent;

wherein the sealed base member prevents fluids from entering a hole in the roof where the plumbing vent pipe protrudes through.

12. The plumbing vent pipe cover of claim 11 wherein the cover is pre-molded in its final form prior to installation of said cover.

13. The plumbing vent pipe cover of claim 11 wherein said body member and said base member are constructed from poly vinyl chloride.

14. The plumbing vent pipe cover of claim 11 wherein said base member having a plurality of holes sized to accept mounting hardware.

15. The plumbing vent pipe cover of claim 14 wherein said base member having eight holes equally spaced from the center of the base plate.

16. The plumbing vent pipe cover of claim 11 wherein the base has a tapered perimeter.

17. The plumbing vent pipe cover of claim 11 wherein said exterior section is greater in length than a portion of the plumbing stack vent which protrudes out of the roof.

18. A plumbing vent pipe cover for flashing a plumbing stack vent that protrudes from a roof of a building or dwelling, the stack vent having an outer diameter and an inner diameter and being substantially cylindrical in shape, a portion of the plumbing stack vent protruding out of the roof, said cover comprising;

a base member having a bottom surface and a top surface, said base member constructed from a non-metallic material, said base member adapted to be attached and sealed to the roof to prevent moisture leakage and drainage on and around the vent pipe, said base member having a plurality of mounting apertures sized to accept mounting hardware, said base member constructed from poly vinyl chloride;

a substantially cylindrically shaped body member constructed from a non-metallic material, said body member including an exterior section, intermediate section and an interior section, said exterior section, intermediate section and interior section defining a channel therebetween, said body member constructed integral with said base member, said exterior section having an inner diameter larger than the outer diameter of the stack vent, said interior section having an outer diameter smaller than the inner diameter of the stack vent, said exterior section greater in length than the portion of the plumbing stack vent protruding out of the roof, said body member constructed from poly vinyl chloride, said body member constructed integral with said base member to define a one-piece cover member;

wherein when said cover is installed a portion of said interior section is disposed within said stack vent and said interior section terminates at a point lower than an upper most point of the plumbing stack vent to direct moisture or fluids into the stack vent;

wherein said cover is pre-molded in final form prior to installation; herein the sealed base member prevents fluids from entering a hole in the roof where the plumbing vent pipe protrudes through;

wherein said cover is capable of being installed prior to the installation of the plumbing stack vent.

19. The plumbing vent pipe cover of claim 1 wherein said cover is capable of being installed prior to the installation of the plumbing stack vent.

20. The plumbing vent pipe cover of claim 11 wherein said cover is capable of being installed prior to the installation of the plumbing stack vent.

* * * * *